US006028400A

United States Patent [19]

Pol et al.

[11] Patent Number: 6,028,400

[45] Date of Patent: Feb. 22, 2000

[54] DISCHARGE LAMP CIRCUIT WHICH LIMITS IGNITION VOLTAGE ACROSS A SECOND DISCHARGE LAMP AFTER A FIRST DISCHARGE LAMP HAS ALREADY IGNITED

[75] Inventors: Nicolaas H. M. Pol; Paul R. Veldman; Johannes M. Van Meurs, all of Oss, Netherlands

[73] Assignee: U.S. Philips Corporation, New York, N.Y.

[21] Appl. No.: 08/710,995

[22] Filed: Sep. 25, 1996

[30] Foreign Application Priority Data

Sep. 27, 1995 [EP] European Pat. Off. ..... 95202596

[51] Int. Cl.[7] ..... H05B 37/02

[52] U.S. Cl. ..... 315/225; 315/DIG. 7; 315/324; 315/294; 315/307

[58] Field of Search ..... 315/225, DIG. 7, 315/307, 291, 294, 324

[56] References Cited

U.S. PATENT DOCUMENTS 4,370,600 1/1983 Zansky ..... 315/244
4,392,087 7/1983 Zansky ..... 315/219
4,441,054 4/1984 Bay ..... 315/219
4,585,974 4/1986 Stupp et al. ..... 315/DIG. 7
4,949,015 8/1990 Nilssen ..... 315/200 R

*Primary Examiner*—Michael B Shingleton
*Attorney, Agent, or Firm*—Bernard Franzblau

[57] ABSTRACT

A circuit arrangement for igniting and operating at least two discharge lamps. the circuit is provided with input terminals (K1,K2) for connection to a supply voltage source and a circuit I (SC, S1, S2) coupled to the input terminals for generating a high-frequency voltage from a supply voltage delivered by the supply voltage source. A load branch B is coupled to the circuit I and comprising a first branch A including first terminals (K3,K3') for accommodating a discharge lamp and a first inductive element L1, and a second branch C shunting the first branch A and comprising further terminals (K4,K4') for accommodating a discharge lamp and a second inductive element L2 which is magnetically coupled to the first inductive element L1. A circuit II limits the voltage across branch A and branch C to a first value during the ignition of the discharge lamps. A circuit III limits the voltage across branch A and branch C to a second value after the ignition of one of the discharge lamps thereby preventing the occurrence of ignition voltages of very high amplitude across the discharge lamp igniting last.

4 Claims, 1 Drawing Sheet

DISCHARGE LAMP CIRCUIT WHICH LIMITS IGNITION VOLTAGE ACROSS A SECOND DISCHARGE LAMP AFTER A FIRST DISCHARGE LAMP HAS ALREADY IGNITED

BACKGROUND OF THE INVENTION

1. Field of the Invention

This invention relates to a circuit arrangement for igniting and operating at least two discharge lamps, provided with input terminals for connection to a supply voltage source, means I coupled to the input terminals for generating a high-frequency voltage from a supply voltage delivered by the supply voltage source, a load branch B coupled to the means I and comprising a first branch A comprising first terminals for accommodating a discharge lamp and a first inductive element L1, a second branch C shunting the first branch A and comprising further terminals for accommodating a discharge lamp and a second inductive element L2 which is magnetically coupled to the first inductive element L1, and means II for limiting the voltage across branch A and branch C to a first value during the ignition of the discharge lamps.

2. Description of the Related Art

Such a circuit arrangement is known from U.S. Pat. No. 4,441,054. The known circuit arrangement is suitable for operating two discharge lamps. The first inductive element L1 and the second inductive element L2 together form a balancer transformer. This balancer transformer achieves during lamp operation that the currents through the two discharge lamps are approximately equal. This is important especially when the circuit arrangement offers the possibility of dimming the discharge lamps, since otherwise the luminous fluxes of the discharge lamps may differ considerably in the dimmed state, which is regarded as undesirable in many applications. It is a disadvantage of the known circuit arrangement, however, that with one of the discharge lamps ignited and the other discharge lamp not yet ignited during the ignition phase, a voltage having a very high amplitude is present across said other discharge lamp. Such a very high voltage conflicts with the safety requirements such as, for example, those formulated in IEC 928. A second disadvantage is that in this situation a current with a comparatively high amplitude flows through the inductive element forming part of the branch in which the already ignited discharge lamp is present. The balancer transformer should be dimensioned such that no saturation of the balancer transformer occurs at a result of this current of comparatively high amplitude because otherwise current pulses will arise which will considerably shorten the lives of at least part of the components from which the circuit arrangement is built up. The result of this is that the balancer transformer in the known circuit arrangement is a comparatively voluminous and expensive component.

SUMMARY OF THE INVENTION

It is an object of the invention to provide a circuit arrangement for operating and igniting at least two discharge lamps with which the currents through the two discharge lamps can be kept substantially equal to one another, while no voltage of very high amplitude arises across one of the discharge lamps during the ignition of the discharge lamps, and the occurrence of a current of very high amplitude through one of the inductive elements is avoided.

According to the invention, a circuit arrangement as described in the opening paragraph is for this purpose characterized in that the circuit arrangement is in addition provided with means III for limiting the voltage across branch A and branch C to a second value after the ignition of one of the discharge lamps.

Through a suitable choice of the second value, and in spite of the fact that considerable voltages are present across the inductive elements after the ignition of one of the discharge lamps, it is avoided that the voltage across the not (yet) ignited discharge lamp reaches a very high value, so that the circuit arrangement is comparatively safe for a user. A suitable choice of the second value also has the advantage that the voltages across the inductive elements after ignition of one of the discharge lamps do not become so high that the balancer transformer must be of a comparatively large construction in order to avoid saturation of the balancer transformer during ignition.

The high-frequency voltage present across branch A and branch C is related to the high-frequency voltage present across each of the inductive elements. With neither of the discharge lamps in the ignited state, no current will flow through the inductive elements, so that substantially no voltage is present across the inductive elements. High-frequency currents flow through the two inductive elements when the two discharge lamps have ignited. Each of these high-frequency currents generates a voltage across one of the inductive elements as a result of the finite impedance of this inductive element to the high-frequency current. The magnetic coupling between the two inductive elements transforms the voltage across each of the inductive elements to the other inductive element. The inductive elements are so constructed that the voltage present across each inductive element as a result of the finite impedance to the high-frequency current is substantially compensated by the voltage present across the inductive element as a result of the magnetic coupling with the other inductive element. As a result of this, the voltage across the inductive elements is again substantially equal to zero when both discharge lamps are ignited. When one of the discharge lamps is ignited and the other discharge lamp is not, however, a high-frequency current will flow through the inductive element forming part of the branch in which the ignited discharge lamp is present, so that a high-frequency voltage is present across this inductive element. This high-frequency voltage induces a high-frequency voltage across the other inductive element again via the magnetic coupling between the two inductive elements. A voltage is present across the inductive elements which differs substantially from zero only in the situation in which one of the discharge lamps is ignited and the other discharge lamp is not. A limitation of the voltage across branch A and branch C may accordingly be realised in a comparatively simple manner when the means III comprise means for limiting the voltage across one of the inductive elements L1 and L2. The means for limiting the voltage across one of the inductive elements will operate exclusively when only one of the discharge lamps is ignited. Since a limitation of the voltage across one of the inductive elements achieves a limitation of the voltage across branches A and C, it is achieved in a simple manner that a limitation of the voltage across branches A and C to the second value is only effected when only one of the discharge lamps is ignited.

Good results were achieved with practical embodiments of a circuit arrangement according to the invention in which the means I comprise a bridge circuit and/or in which the means II are provided with means for controlling the frequency of the high-frequency voltage.

BRIEF DESCRIPTION OF THE DRAWINGS

An embodiment of the invention will be explained in more detail with reference to a drawing, in which.

DESCRIPTION OF THE PREFERRED EMBODIMENTS

Figure 1:
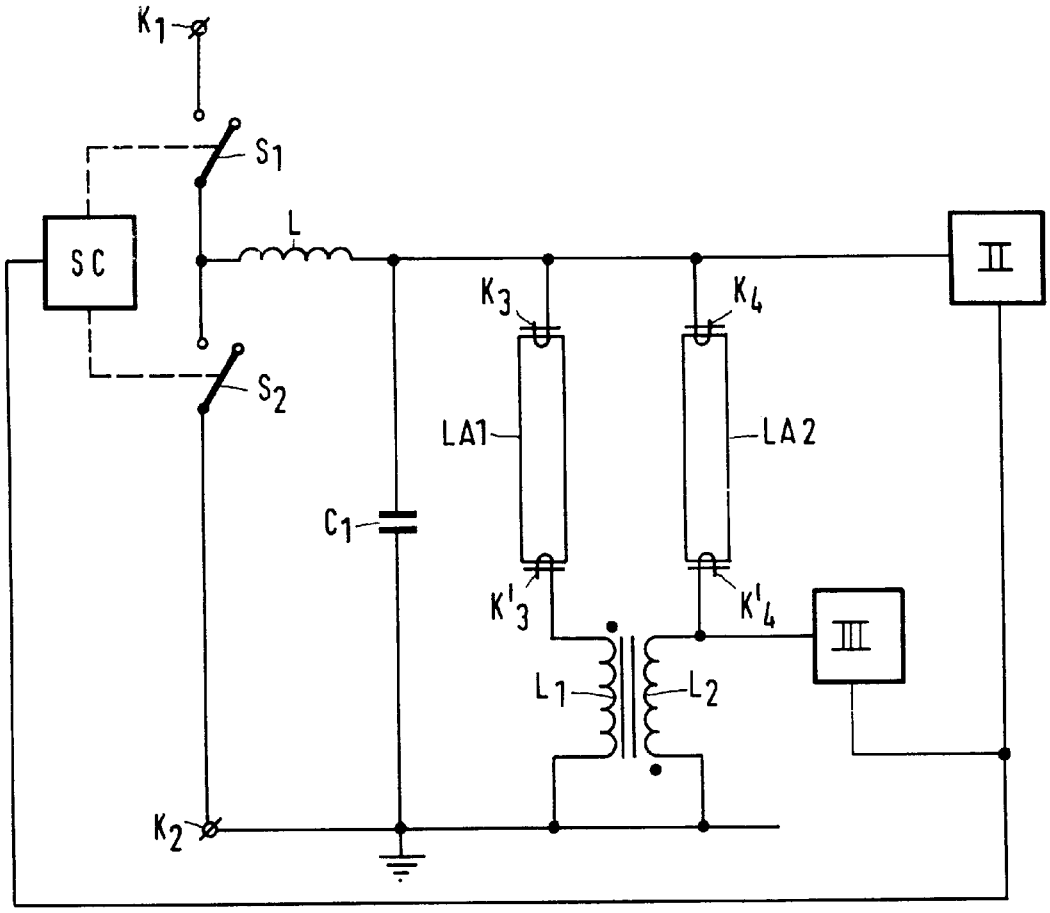
FIG. 1 is a diagram of an embodiment of a circuit arrangement according to the invention, with two discharge lamps connected thereto.

In the embodiment shown in FIG. 1, K1 and K2 form input terminals for connection to a supply voltage source. This supply voltage source must deliver a DC voltage in the present case. Switching elements S1 and S2 together with circuit portion SC form means I for generating a high-frequency voltage from the DC voltage. Circuit portion SC forms a trigger circuit for generating a high-frequency control signal for rendering the switching elements S1 and S2 conducting and non-conducting at a high frequency. Ballast coil L, capacitor C1, first terminals for accommodating a discharge lamp K3 and K3', further terminals K4 and K4' for accommodating a discharge lamp, and inductive elements L1 and L2 together form a load branch B. Discharge lamp LA1 and discharge lamp LA2 are connected to the first and the further terminals for accommodating a discharge lamp, respectively. Branch A is formed by a series arrangement of terminal K3, discharge lamp LA1, terminal K3', and inductive element L1. Branch C is formed by a series arrangement of terminal K4, discharge lamp LA2, terminal K4', and inductive element L2. The inductive elements L1 and L2 both comprise a number of turns of copper wire around the same magnetizable core. The number of turns of inductive element L1 is equal to the number of turns of inductive element L2, but the winding direction of the turns of inductive element L1 is opposed to that of inductive element L2. The two inductive elements are magnetically coupled to one another via the magnetizable core and together form a balancer transformer. Circuit portion II in this embodiment forms means II for limiting the voltage across branch A and branch C to a first value during the ignition of the discharge lamps. Circuit portion III forms means III for limiting the voltage across branch A and branch C to a second value after the ignition of one of the discharge lamps. The means III in this embodiment are constructed as means for limiting the voltage across inductive element L2.

Input terminals K1 and K2 are interconnected by a series circuit of switching element S1 and switching element S2. Outputs of circuit portion SC are coupled to respective control electrodes of switching element S1 and switching element S2. These couplings are indicated in FIG. 1 with broken lines. Switching element S2 is shunted by a series arrangement of ballast coil L and capacitor C1. Capacitor C1 is shunted by branch A and by branch C. An input of circuit portion II is connected to a common junction point of branch A and ballast coil L. An output of circuit portion II is connected to an input of trigger circuit SC. An input of circuit portion III is connected to a common junction point of inductive element L2 and terminal K4'. An output of circuit portion III is connected to the input of trigger circuit SC.

The operation of the embodiment shown in FIG. 1 is as follows.

When the input terminals K1 and K2 are connected to a supply voltage source, the trigger circuit SC renders the switching elements S1 and S2 alternately conducting and non-conducting with high frequency. A high-frequency voltage is present across branch A and branch C as a result of this. During a first part of the ignition phase, the two discharge lamps have not yet ignited, i.e. immediately after switching-on of the circuit arrangement. The means II limit the voltage across branches A and C to a first value during this first part of the ignition phase. This is done in the present example in that the means II controls the frequency of the control signal via the trigger circuit SC such that the voltage across branch A and branch C does not exceed the first value. The ignition of one of the discharge lamps marks the transition from the first part of the ignition phase to a second part of the ignition phase. Assuming discharge lamp LA1 to be ignited, a high-frequency current will flow in inductive element L1 during this second part of the ignition phase, and a high-frequency voltage will be present across inductive element L1. Owing to the magnetic coupling between inductive element L1 and inductive element L2, a high-frequency voltage is also present across inductive element L2, the amplitude of which is substantially equal to the amplitude of the high-frequency voltage across inductive element L1, while the phase is substantially opposed to that of the high-frequency voltage across inductive element L1. This means that the high-frequency voltage across the inductive element L2 is also strongly phase-shifted relative to the high-frequency voltage across branch A and branch C. If the circuit arrangement were not provided with means III according to the invention, the means II would maintain the voltage across branch A and branch C at the first value also after the ignition of one of the discharge lamps. The amplitude of the high-frequency voltage across inductive element L2 would have a comparatively great amplitude as a result of this. The comparatively great amplitudes of the high-frequency voltage across branch C and the high-frequency voltage across inductive element L2 in combination with the strong phase shift between these two high-frequency voltages would lead to a strong increase in the amplitude of the high-frequency voltage across the discharge lamp LA2. In the embodiment shown in FIG. 1, however, the means III limit the voltage across inductive element L2, and thus the voltage across branch A and branch C, during the second part of the ignition phase in that the means III control the frequency of the control signal via the trigger circuit SC such that the voltage across branch A and branch C does not exceed the second value. Since the amplitudes of the high-frequency voltages across branch C and across inductive element L2 are limited, the amplitude of the high-frequency voltage across discharge lamp LA2 is also limited. A suitable choice of the second value, and thus also of the value to which the voltage across inductive element L2 is limited, can achieve that the amplitude of the high-frequency voltage across the discharge lamp(s) is approximately the same in the first and in the second part of the ignition phase.

Figure 2:
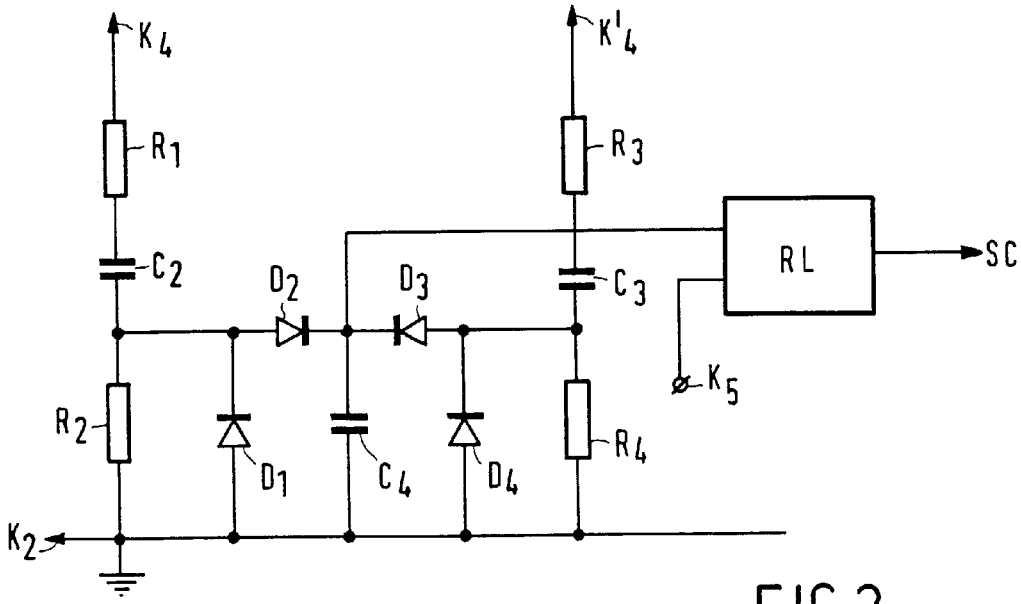
FIG. 2 shows a portion of the circuit arrangement of FIG. 1 in more detail.

In FIG. 2, circuit portion II is formed by ohmic resistors R1 and R2, capacitors C2 and C4, diodes D1 and D2, and control circuit RL. Circuit portion III is formed by ohmic resistors R3 and R4, capacitors C3 and C4, diodes D3 and D4, and control circuit RL. Further terminal K4 is connected to input terminal K2 via a series arrangement of ohmic resistor R1, capacitor C2, and ohmic resistor R2. A common junction point of ohmic resistor R2 and capacitor C2 is connected to a cathode of diode D1 and to an anode of diode D2. A cathode of diode D2 is connected to a cathode of diode D3 and to a first side of capacitor C4. A further side of capacitor C4 is connected to an anode of diode D1 and to input terminal K2. Further terminal K4' is connected to input terminal K2 via a series arrangement of ohmic resistor R3, capacitor C3, and ohmic resistor R4. A common junction point of ohmic resistor R4 and capacitor C3 is connected to a cathode of diode D4 and an anode of diode D3. The further side of capacitor C4 is connected to an anode of diode D4. The first side of capacitor C4 is connected to a first input of the control circuit RC. A further input of the control circuit RL connected to a terminal K5 at which a reference voltage Vref is present during operation of the circuit arrangement, generated by means not shown in FIG. 2. An output of control circuit RL connected to the input of trigger circuit SC.

The operation of the portion of the embodiment of FIG. 1 shown in FIG. 2 is as follows. When the circuit arrangement is operational and neither lamp LA1 nor LA2 has ignited, the high-frequency voltage between further terminal K4 and input terminal K2 (=the high-frequency voltage across branch A and branch C) has a comparatively great amplitude, so that also the voltage across ohmic resistor R2 has a comparatively great amplitude. Capacitor C4 is charged during this phase of lamp operation up to a voltage which is substantially equal to the maximum amplitude of the voltage across ohmic resistor R2. If the voltage across capacitor C4 rises to a value which is substantially equal to the reference voltage Vref present at terminal K5, the frequency and/or duty cycle of the control signal generated by the trigger circuit SC is influenced via the control circuit RL such that the amplitude of the voltage across branch A and branch C does not rise any further. Before the first discharge lamp ignites, the amplitude of the high-frequency voltage between further terminal K4' and input terminal K2 (=the high-frequency voltage across the inductive element L2) is comparatively low, so that the same holds for the amplitude of the voltage across ohmic resistor R4, and the capacitor C4 is not charged by the voltage across ohmic resistor R4. After one of the discharge lamps has ignited, the voltage across branch A and branch C decreases further, while the voltage across the inductive element L2 rises steeply, so that also the voltage across ohmic resistor R4 rises strongly, and capacitor C4 is charged up to a voltage which is substantially equal to the maximum amplitude of the voltage across ohmic resistor R4. If the voltage across capacitor C4 rises to a value substantially equal to the reference voltage Vref present at terminal K5, the frequency and/or the duty cycle of the control signal generated by the trigger circuit SC is influenced via the control circuit RL such that the amplitude of the voltage across the inductive element L2, and thus the voltage across the not yet ignited discharge lamp, does not rise any further. Capacitor C2 and capacitor C3 act as DC decoupling capacitors. The resistance values of ohmic resistors R1, R2, R3 and R4 are so chosen that the limitation of the voltage across branch A and branch C to a first value and subsequently to a second value can be realised with a single reference voltage.

The rms value of the ignition voltage during the first part of the ignition phase was measured to be approximately 500 V in a practical realisation of the embodiment shown in FIG. 1 with which two low-pressure mercury discharge lamps with a power rating of 50 W can be ignited and operated. When the means III were purposely deactivated, the RMS value of the ignition voltage across the not yet ignited discharge lamp was approximately 1,000 V during the second part of the ignition phase. The rms value of this voltage was approximately 580 V when the means III did limit the voltage across the not yet ignited discharge lamp.

We claim:

1. A circuit arrangement for igniting and operating at least two discharge lamps, comprising:

input terminals for connection to a supply voltage source, means I coupled to the input terminals for generating a high-frequency voltage from a supply voltage delivered by the supply voltage source, a load branch B coupled to the means I and comprising:

a first branch A comprising first terminals for accomodating a discharge lamp and a first inductive element L1, a second branch C shunting the first branch A and comprising further terminals for accomodating another discharge lamp and a second inductive element L2 which is magnetically coupled to the first inductive element L1, means II for limiting the voltage across branch A and branch C to a first value during ignition of the first one of the discharge lamps to ignite, and means III for limiting the voltage across branch A and branch C to a second value after ignition of the first one of the discharge lamps to ignite and during ignition of the other one of the discharge lamps, thereby limiting ignition voltage across the other one of the discharge lamps after ignition of the first one of the discharge lamps to ignite.

2. A circuit arrangement as claimed in claim 1, wherein the means III comprise means for limiting the voltage across one of the inductive elements L1 and L2.

3. A circuit arrangement as claimed in claim 1, wherein the means I comprise a bridge circuit.

4. A circuit arrangement as claimed in claim 1, wherein the means II are provided with means for controlling the frequency of the high-frequency voltage.

* * * * *